US005079986A

United States Patent [19]

Lee

[11] Patent Number: 5,079,986

[45] Date of Patent: Jan. 14, 1992

[54] DIE FOR CRIMPING BULLETS IN AMMUNITION CASES

[76] Inventor: Richard J. Lee, 3146 Kettle Moraine Rd., Hartford, Wis. 53027

[21] Appl. No.: 613,286

[22] Filed: Nov. 15, 1990

[51] Int. Cl.[5] ..... F42B 33/12

[52] U.S. Cl. ..... 86/39; 86/40

[58] Field of Search ..... 86/39, 40

[56] References Cited

U.S. PATENT DOCUMENTS

| | | | |
|---|---|---|---|
| 2,552,772 | 5/1951 | Fasig | 86/37 |
| 2,700,915 | 2/1955 | Pattison | 86/39 |
| 4,385,546 | 5/1983 | Lee | 86/39 |
| 4,723,472 | 2/1988 | Lee | 86/39 |

*Primary Examiner*—Deborah L. Kyle
*Assistant Examiner*—J. Woodrow Eldred
*Attorney, Agent, or Firm*—Fuller, Ryan & Hohenfeldt

[57] ABSTRACT

A cylindrical die body has an axial bore in which there is an annular tapered shoulder. A cylindrical collet is adapted to fit coaxially in the bore of the cylindrical body. The collet has an axial bore extending over the majority of its length for accommodating the body of an ammunition case and has a smaller coaxial bore through which a bullet installed in the mouth of the case can extend. The fingers of the collet terminate in finger tips which surrounds the small bore. The mouth of the case which holds the bullet extends into the space between the collet finger tips such that when the collet is pressed into the cylindrical die body, tapered surfaces exterior of the collet run ionto the tapered shoulder in the die body to generate a wedging action which forces the tips of the collet fingers in a radial direction into the mouth end of the cartridge case to thereby crimp the mouth end of the case to the bullet.

4 Claims, 2 Drawing Sheets

DIE FOR CRIMPING BULLETS IN AMMUNITION CASES

BACKGROUND OF THE INVENTION

The invention disclosed herein pertains to a die for crimping bullets in ammunition cases in connection with reloading spent cases.

Reloading spent ammunition cases typically involves removing and replacing the spent primer cap in the head of the case. After that step there is usually a shaping of the mouth end and possibly the body portion of the case. The case is then filled with a predetermined quantity of powder and a bullet is inserted in the open end or mouth. The neck is then crimped to secure the bullet. A roll crimp is used on most hand loaded ammunition. The mouth of the case is rolled into the bullet crimping groove by pushing the case against an angled shoulder within a bullet seating die. This is exemplified in U.S. Pat. No. 4,385,546 which shows a die used for forcing the bullet into the mouth of the case. As the ammunition case with a bullet set in it is forced into the die, the bullet strikes a stop which pushes the bullet into the case to the proper depth and, when it reaches the proper depth, the very edge of the mouth of the case encounters an annular tapered shoulder which rolls the edge of the mouth into the bullet.

When the hand loader crimps in this manner, tightness of the bullets is usually far from being as uniform as is obtained by the original manufacturer. A uniform and firm crimp is desirable for ammunition that is subject to rough handling such as when it is handled by hunters or carried in their pockets. If the crimp is not firm the bullet may become misaligned or loosened. The result is that the start or initial pressure generated by ignition of the powder in the case will not be uniform in which case accuracy of the bullet is decreased. Those who reload their own ammunition know that the most important factor for accuracy is a uniform start pressure. Until the present invention was made, hand loaders had to obtain a uniform start pressure by seating the bullet so that it would just touch or nearly touch the rifling in the breech of the gun. Manufacturers supply ammunition originally which has a uniform start pressure because the crimp on the bullet is uniform. Tests have demonstrated that bullets crimped properly, that is, uniformly and with sufficient gripping force, have less velocity variation.

The conventional roll crimp leaves much to be desired in that case length must be very uniform to secure a uniform sound crimp. If the crimp die is incorrectly adjusted, excessive axial force on the case mouth can bulge the case just behind the crimp or push out the shoulder of the case. It is because there is relative motion between the mouth of the case and the die in conventional crimping dies that this accidental overcrimping and bulging of the case body and the neck of the case occurs.

SUMMARY OF THE INVENTION

The new crimping die is distinguished by using a collet member to press the open edge or mouth of the case into the periphery of the bullet. The collet member has a bore which admits the body of the case with substantial clearance around it since, by crimping with a collet, wherein pads on the collet finger are driven radially inwardly against the mouth of the case, there are never any axial forces developed which could result in bulging out of the neck or body of the case. It remains certain that the case, which has been previously fired and slightly expanded to make a perfect fit in the breech of the gun will maintain that fit when the reloaded case is fired again.

The tips of the collet member fingers are beveled so that when the collet member is forced into the die body which has a complementarily shaped internal shoulder, the fingers of the collet member will be forced radially inwardly to effect the crimp without any axial component of force which could cause bulging being developed in the case.

U.S Pat. No. 4,723,472, which issued to the applicant herein, discloses employing a collet in an ammunition case neck sizing die. In the patent, the collet fingers are beveled externally and they encounter a complementarily internally beveled stop member in the die body so that the neck of the case is squeezed onto a rod which fits through the mouth of the case and is just slightly under the diameter of the bullet that will be inserted in the mouth so the bullet will fit in a stable fashion until it is crimped in the new crimping die, for example. This collet utilizing die simply sizes the neck of the case but is not adapted to bullet crimping.

The objectives achieved with the new die include producing reloaded ammunition cases which have the bullet seized in the mouth of the case with a repeatable or uniform force. The new crimping die is tolerant and forgiving of minor variations in the length of the case. The die is incapable of producing any axial forces on the case which would result in it becoming bulged so as to make a misfit in the chamber of a gun in which the case has been fired.

How the foregoing and other objectives of the invention are achieved will appear in the ensuing more detailed description of a preferred embodiment of the new crimping die in reference to the drawings.

DESCRIPTION OF A PREFERRED EMBODIMENT

Figure 1:
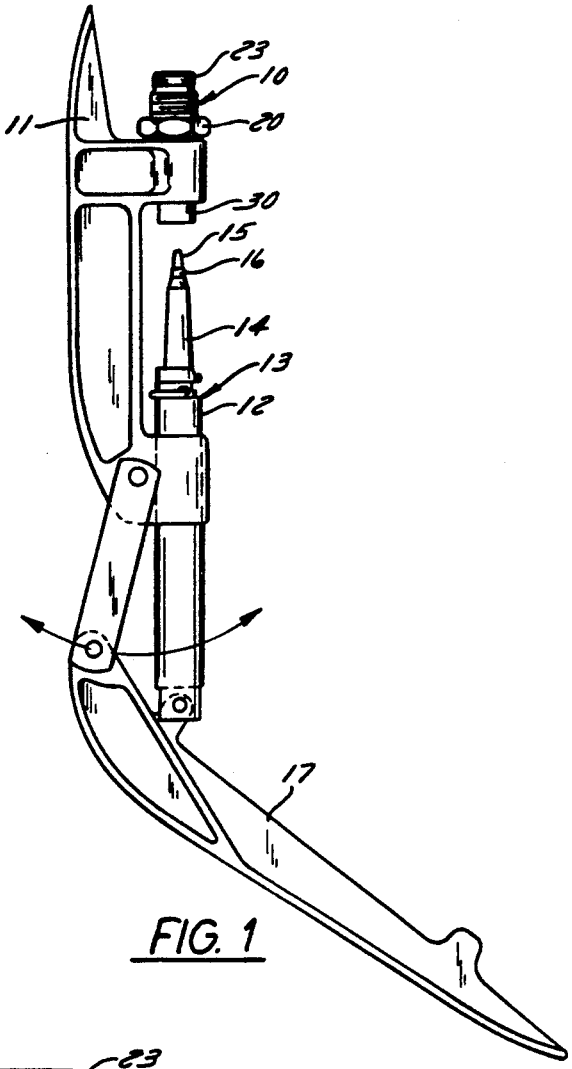
FIG. 1 depicts the new crimping die mounted in a hand held press which is used for reloading ammunition cases by employing several different dies.

FIG. 1 shows the new bullet crimping die 10 mounted in the body of a hand held reloading press. The die can be used in other types of hand held presses and bench mounted presses as well. The illustrative press comprises a body 11 in which there is an axially slidable ram 12 which has a case holder 13 mounted to it. An ammunition case 14 is presently mounted in the holder and is in readiness for being driven into the die 10 to effect a bullet crimping operation. The bullet 15 has been previously pressed into the neck of the ammunition case. Swinging the handle 17 counterclockwise from the position in which it is shown in FIG. 1 results in pushing the ammunition case 14 into die 10.

Figure 2:
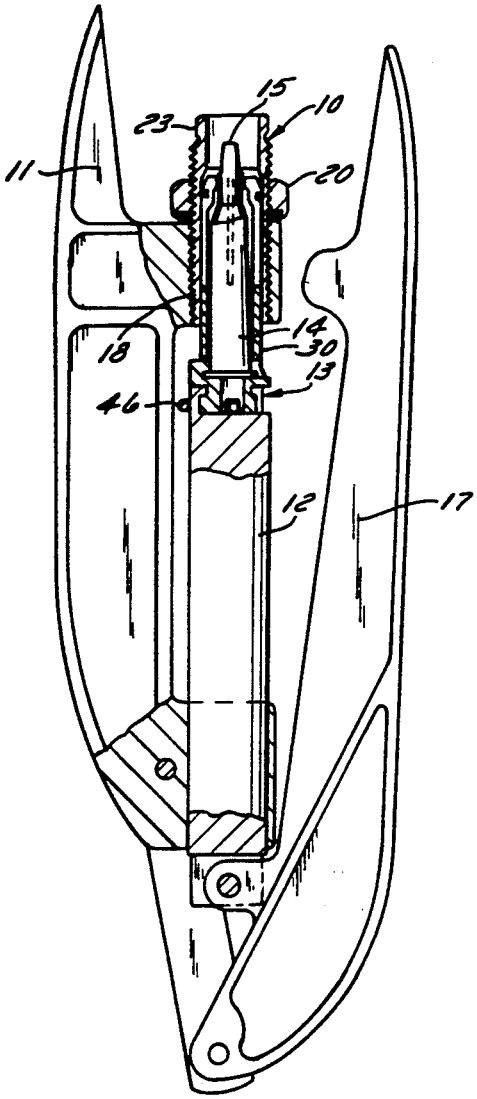
FIG. 2 depicts the same press and shows the handles of the press brought together to develop the forces for driving the case containing a bullet which is to be crimped into the die body along with a collet.

FIG. 2 shows the handle 17 swung counterclockwise relative to press body 11 to insert the case 14 far enough into the die body 18 for the crimping action to begin.

Figure 3:
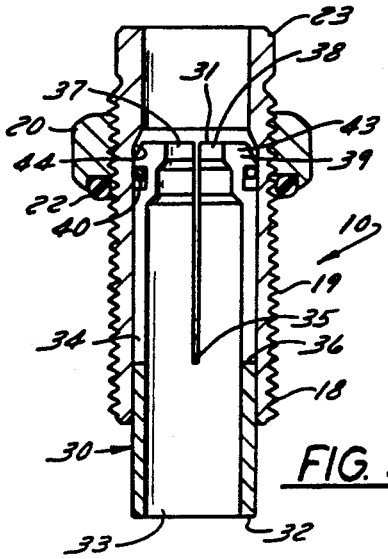
FIG. 3 is a vertical sectional view of the crimping die without the die being mounted in a reloading press and without an ammunition case being present in the die.

FIG. 3 is a longitudinal section through the new crimping die where it is seen that it comprises a generally cylindrical die body 18 on which there is an external thread 19. The external thread 19 provides for screwing the die body 18 into a corresponding internal thread 19 in the press as is evident from inspection of FIGS. 1 and 2. A lock nut 20 is turned onto thread 19. The lock nut is provided with an annular groove 21 which is occupied by a rubber o-ring 22. When the die body 18 is screwed into the press as in FIG. 2, lock nut 20 is hand tightened sufficiently to exert a squeezing pressure on o-ring 22 so that the friction of the ring will resist inadvertent turning of the lock nut. This assures that the body 19 will stay in a fixed position relative to the ram 12 and case holder 13 of the press. The body 18 of the die is screwed into the press by just the right amount so that when the case is pushed to its limit by the limit of the ram 12 travel, the correct area of the mouth 16 of the ammunition case will be pressed into the bullet with the correct amount of exclusively radial force.

Figure 4:
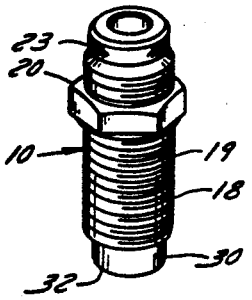
FIG. 4 is an external perspective view of the die by itself.

Reference is made to FIG. 3 again and to FIG. 4 to note that the die body 18 terminates at its nominally upper end in a cylindrical part 23 which is knurled for the purpose of facilitating screwing the die body into the press.

Figure 10:
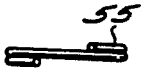
FIG. 10 is a side elevational view of a coil spring which is used in the larger sizes of the crimping die in place of the single c-ring depicted in FIG. 7 to keep the collet member from inadvertently slipping out of the die body.
Figure 7:
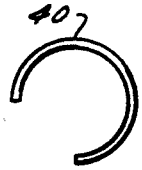
FIG. 7 depicts a springy wire ring which is used in such a way as to maintain a frictional force between the collet member and die body which is sufficient to prevent the collet member from sliding out of the die body inadvertently.

A collet member, generally designated by the numeral 30 is installed coaxially within the axially extending bore of cylindrical body 18. The collet member 30 has a first end 31 and a second end 32 and an axial bore 33 extending over a majority of its axial length from the second end toward the first end for receiving the body portion of an ammunition case which is not depicted in FIG. 3. The collet member 30 is cylindrical and is slitted over part of its length axially with four slits three of which, 34, 35 and 36 are visible in FIG. 3. The four slits divide the collet into four quadrants which may be called fingers such as the ones marked 37 and 38 in FIG. 3. The slits provide the space for allowing the four fingers to be pressed radially inwardly towards each other for squeezing and slightly deforming the neck of an ammunition case to effect the crimping action. At the first or nominally upper end 31 of the collet member 30 one may see in FIG. 3 that the tips of the fingers have an axially extending portion 39 which may be characterized as pads for actually applying the squeezing or crimping force to the edge of the mouth of the ammunition case. The collet is slidable and removable from within the bore of the die body 18 but it is maintained as a unit as a result of a c-ring 40 which is shown isolated from the die in FIG. 7. The c-ring resides in an annular groove 41 in the collet member 30. The c-ring is composed of spring wire and is formed such that in its relaxed state its outside diameter is greater than the inside diameter of the bore 33 in cylindrical body 18. However, the c-ring can be squeezed to assume a smaller diameter as it is forced through the lower end 32 of cylindrical body 18 so that it tends to expand and induce a frictional drag force between the c-ring which is captured on the collet and the bore 33 of the cylindrical die body 18. In the larger dies a multiple convolution ring 55 similar to the coil spring shown in FIG. 10 is used.

Figure 5:
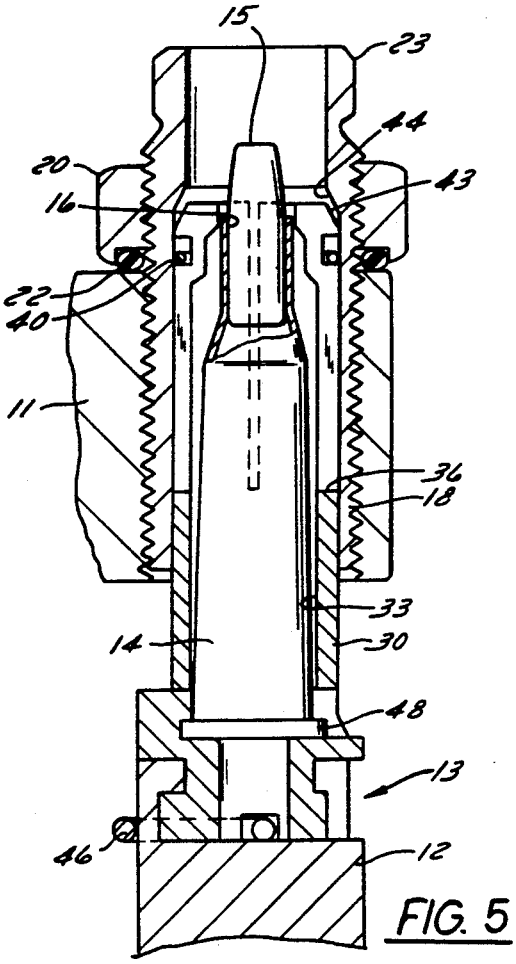
FIG. 5 shows a sectional view of the die with the ammunition case and collet member in the position in which these parts are in just before the crimping action occurs.

It is to be noted at the first or nominally upper end 31 of the collet member 30 the fingers are tapered as indicated by the numeral 43. In FIG. 3 and FIG. 5 the tapered finger ends 43 of the collet member are presently in proximity with but not quite in full contact with complementarily tapered annular shoulder 44 which is formed stationarily inside of cylindrical body 18. By way of example and not limitations, a commercial embodiment has 20° tapers. The manner in which these two tapered surfaces 43 and 44 coact to squeeze the fingers of the collet member 30 radially inwardly to effect a crimping force on the mouth of an ammunition 14 case will be described in detail in reference to other drawing figures.

Attention is now invited to FIG. 5. A fragment of the axially movable ram 12 of a reloading press is shown. A standard ammunition case holder 45 is secured to the ram by means of a snap ring 46. The ammunition case holder 45 is conventional in that it has a side opening 47 which allows the ammunition case rim 48 to be slid into the holder and be captured under the overhanging ledge 49 of the holder which assures that the ammunition case body 14 will be coaxial with the ram. The second or nominally lower end 32 of collet member 30 is shown bearing on the top flat surface 49 of holder 45. Since the case 14 is supported on the same holder as is the cylindrical body of collet 30, the case and collet will always move together. As a result of the case and collet not developing relative axial movement, it is impossible for any axial force to be developed which could result in the case bulging outwardly as is a defect in prior bullet crimping dies.

In FIG. 5, the axially extending pads 39 on the collet fingers are still spaced from the edge or the mouth 16 of the case. The tapered surfaces 43 on the respective ends of the collet fingers and the stationary annular tapered surface 44 formed within cylindrical die body 18 are still spaced from each other. The crimping action has not started.

Figure 6:
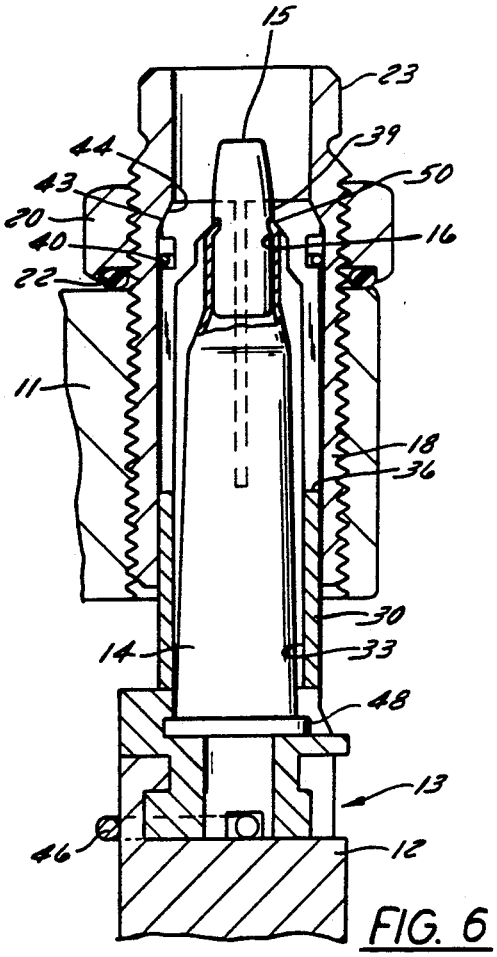
FIG. 6 is similar to FIG. 5 except that the collet member and case have been advanced into the die body a sufficient amount to complete crimping of the mouth of the case to the bullet.

In FIG. 6, the collet member 30 and case 14 have been forced into die body 18 sufficiently far for the crimping action to be completed. This results from the fact that the collet fingers are driven in axially far enough for the tapered surfaces 43 on the tips of the collet fingers and the stationary annular tapered surface 44 in the bore of the cylindrical body to have been driven into contact with each other such as to develop a wedging force on the fingers of the collet member which drives the fingers solely radially inwardly for the flat surfaces or pads 39 on the collet fingers press against the very end or edge of the mouth 16 of the case. A high unit stress is thereby developed Note that only the lower corner 50 of the finger pads 39 comes into contact with the mouth of the case in which case the radially inwardly directed force per unit area at the interface of the case and the collet member fingers is very high and the mouth becomes crimped into the bullet 15 very soundly.

Figure 8:
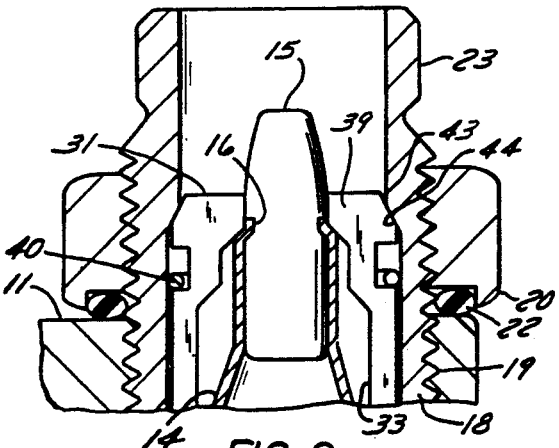
FIG. 8 shows a portion of the die depicted in FIG. 6 in magnified form to illustrate how the mouth of the case is formed for engaging the bullet when the case is squeezed radially inwardly by the action of the collet member.

FIG. 8 shows an enlargement of the manner in which the end or mouth 16 of the case becomes deformed by the crimping action so as to bite into the bullet.

Figure 9:
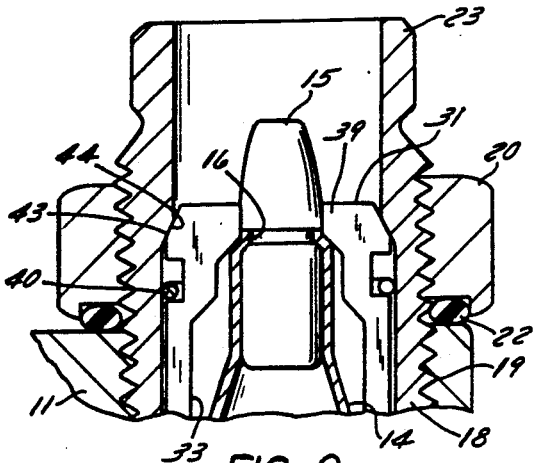
FIG. 9 is similar to FIG. 8 except that in this case the bullet is provided with a cannelure into which the end or mouth of the case is formed to secure the bullet in the case.

FIG. 9 is an enlargement similar to FIGURE 8 except that in this case the bullet 15 is provided with an annular groove or cannelure 51. Cannelures are typically about 0.050 inch wide and about 0.012 inch deep. In this case, the lower corner 50 of the collet fingers curls the end of the mouth of the case right into the cannelure 51 as shown.

It should be noted that the pads 39 on the tips of the collet member fingers such as 37 and 38 are axially untapered although each of the surfaces 39 are curved and concentric when the pads 39 are driven radially inwardly or are in their more outwardly relaxed state.

I claim:

1. A crimper die for use in an ammunition case reloading apparatus which is adapted to advance the case into the die to crimp the mouth of the case to a bullet installed in the mouth, comprising:

a generally cylindrical die body adapted for being mounted to said reloading apparatus and having an axially extending bore in which there is an axially tapered shoulder, a generally cylindrical collet member adapted for fitting concentrically in said bore of the die body and having opposite first and second ends, said collet member having an axial bore extending from said second end toward said first end for accommodating the ammunition case such that after the case is inserted in the collet member the mouth end of the case is proximate to said first end of the collet member, said collet member having a smaller bore in its first end slightly larger in diameter than the diameter of said case at its mouth end, said collet member having axial slits extending from said first end partially over the distance to said second end for dividing said member into circularly arranged radially inwardly flexible fingers which have pressure applying tips facing radially inwardly of said smaller bore, said fingers on their radially outwardly presented sides having tapered regions which react against said tapered shoulder in said die body when said collet member is pressed into said die body to wedge said fingers ad the tips thereon radially inwardly to crimp said mouth of said case to said bullet installed therein, said second end of the collet member axially opposite of said pressure supplying tips of the collet member extending out of said bore of the die body to provide for applying an axially directed force jointly to said collet member and the ammunition case such that the case and collet member advance into the die body together so no axially directed force is developed in the case.

2. The bullet crimper die according to claim 1 wherein there is an annular groove in the periphery of said collet member and a generally circular spring element for being fitted concentrically in said groove; said spring element having an outside diameter, when in its relaxed state and is in said groove before said collet member is inserted in said groove, greater than the inside diameter of the bore in said cylindrical die body; said spring member springing radially inwardly in said groove when said collet member is inserted in said die body for developing a radially outwardly directed force for frictionally retaining said collet member in said die body.

3. The bullet crimper die according to claim 2 wherein said circular spring element is a c-shaped ring.

4. The bullet crimper according to claim 2 wherein said circular spring element is a coil spring.

* * * * *